US011189933B2

(12) United States Patent
Wu

(10) Patent No.: US 11,189,933 B2
(45) Date of Patent: Nov. 30, 2021

(54) PHASE CONTROL DEVICE, ANTENNA SYSTEM, AND METHOD OF CONTROLLING PHASE OF ELECTROMAGNETIC WAVE

(71) Applicant: NEC Corporation, Tokyo (JP)

(72) Inventor: Mingqi Wu, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/772,419

(22) PCT Filed: Dec. 25, 2017

(86) PCT No.: PCT/JP2017/046377
§ 371 (c)(1),
(2) Date: Jun. 12, 2020

(87) PCT Pub. No.: WO2019/130382
PCT Pub. Date: Jul. 4, 2019

(65) Prior Publication Data

US 2021/0075119 A1 Mar. 11, 2021

(51) Int. Cl.
*H01Q 15/00* (2006.01)
*H01Q 3/34* (2006.01)
(Continued)

(52) U.S. Cl.
CPC ..... *H01Q 15/0086* (2013.01); *H01Q 3/34* (2013.01); *H01Q 21/065* (2013.01); *H01Q 21/12* (2013.01)

(58) Field of Classification Search
CPC ..... H01Q 15/002; H01Q 15/0026; H01Q 15/006; H01Q 15/0066; H01Q 15/0086; H01Q 15/02; H01Q 15/08; H01Q 15/10; H01Q 15/148; H01Q 15/23; H01Q 19/06; H01Q 19/062; H01Q 19/10; H01Q 21/0025; H01Q 21/065; H01Q 21/08; H01Q 21/12; H01Q 21/225; H01Q 25/008; H01Q 3/10;
(Continued)

(56) References Cited

U.S. PATENT DOCUMENTS 6,144,512 A 11/2000 Eden
9,583,839 B2 * 2/2017 Liu ..... H01Q 15/0026
(Continued)

FOREIGN PATENT DOCUMENTS

JP 2012-175522 A 9/2012
JP 2016-158042 A 9/2016
(Continued)

OTHER PUBLICATIONS

International Search Report for PCT Application No. PCT/JP2017/046377, dated Dec. 25, 2017.
(Continued)

*Primary Examiner* — Seokjin Kim
(74) *Attorney, Agent, or Firm* — Sughrue Mion, PLLC

(57) ABSTRACT

An object is to advantageously control a phase of an electromagnetic wave with high efficiency in wide bandwidth. A phase control device includes a two dimensional array of a plurality of cube units that are configured to shift a phase of an electromagnetic wave passing through the cube units. The cube units include at least two basic structures including different number of stacked metal layers separated from each other.

8 Claims, 19 Drawing Sheets

(51) Int. Cl.
*H01Q 21/06* (2006.01)
*H01Q 21/12* (2006.01)

(58) Field of Classification Search
CPC .. H01Q 3/12; H01Q 3/18; H01Q 3/20; H01Q 3/30; H01Q 3/34; H01Q 3/36; H01Q 3/44; H01Q 3/46
See application file for complete search history.

(56) References Cited

U.S. PATENT DOCUMENTS

| | | | | |
|---|---|---|---|---|
| 2012/0212395 | A1 | 8/2012 | Sanada | |
| 2014/0200458 | A1 | 7/2014 | Sonkusale et al. | |
| 2015/0303584 | A1 | 10/2015 | Liu et al. | |
| 2015/0364828 | A1 | 12/2015 | Liu et al. | |
| 2016/0361002 | A1* | 12/2016 | Palikaras | A61B 5/0507 |
| 2017/0062945 | A1* | 3/2017 | Foo | H01Q 15/10 |
| 2019/0260135 | A1* | 8/2019 | Kasahara | H01Q 13/10 |

FOREIGN PATENT DOCUMENTS

| | | | |
|---|---|---|---|
| WO | 2014/158107 | A1 | 10/2014 |
| WO | 2015/128657 | A1 | 9/2015 |

OTHER PUBLICATIONS

Written opinion for PCT Application No. PCT/JP2017/046377, dated Dec. 25, 2017.
Kuse et al., Variable Reflection Angle Meta-Surface using Double Layered Patch Type FSS, Proceedings of the 2014 IEICE Electronics Society Conference, BCS-1-9, Sep. 23, 2014, Japan.
Tymcheko et al., Ultrathin Nonlinear Metasurfaces with Continuous Phase Control at the Nanoscale, 2016 10th European Conference on Antennas and Propagation (EuCAP), IEEE, Apr. 10, 2016, USA.

* cited by examiner

PHASE CONTROL DEVICE, ANTENNA SYSTEM, AND METHOD OF CONTROLLING PHASE OF ELECTROMAGNETIC WAVE

This application is a National Stage Entry of PCT/JP2017/046377 filed on Dec. 25, 2017, the contents of all of which are incorporated herein by reference, in their entirety.

TECHNICAL FIELD

The present invention relates to a phase control device, an antenna system, and a method of controlling a phase of an electromagnetic wave.

BACKGROUND ART

One of general phase control devices is disclosed in Patent Literature 1. The device includes a structure having a metasurface for coupling electromagnetic radiation. The structure includes a substrate component and a plurality of elements supported by the substrate component. The substrate component has a thickness no greater than a wavelength of the electromagnetic radiation. Each element has a dimension no greater than the wavelength of the electromagnetic radiation. At least two of the elements are non-identical.

CITATION LIST

Patent Literature

PTL 1: International Patent Publication No. WO2015/128657A1

SUMMARY OF INVENTION

Technical Problem

The device disclosed in Patent Literature 1 has the elements included in the structure that approaches resonance state so that a large current flow causes and a bandwidth becomes narrow. As a result, the disclosed device has relatively high loss.

The present invention has been made in view of the above-mentioned problem, and an objective of the present invention is to advantageously control a phase of an electromagnetic wave with high efficiency in wide bandwidth.

Solution to Problem

An aspect of the present invention is a phase control device including a two-dimensional array of three-dimensional units, in which the two-dimensional array is configured to shift a phase of an electromagnetic wave passing through the three-dimensional units, each three-dimensional unit includes one of basic structures, each basic structure includes stacked metal layers separated from each other, and the number of the metal layers of the basic structures are different from each other.

An aspect of the present invention is an antenna system including: an antenna configured to emit an electromagnetic wave; and a phase control device including a two-dimensional array of three-dimensional units, in which the two-dimensional array is configured to shift a phase of an electromagnetic wave passing through the three-dimensional units, each three-dimensional unit includes one of basic structures, each basic structure comprises stacked metal layers separated from each other, and the number of the metal layers of the basic structures are different from each other.

An aspect of the present invention is a method of controlling a phase of electromagnetic wave including emitting an electromagnetic wave to a phase control device, in which the phase control device includes a two-dimensional array of three-dimensional units, the two-dimensional array is configured to shift a phase of an electromagnetic wave passing through the three-dimensional units, each three-dimensional unit includes one of basic structures, each basic structure includes stacked metal layers separated from each other, and the number of the metal layers of the basic structures are different from each other.

Advantageous Effects of Invention

According to the present invention, it is possible to advantageously control a phase of an electromagnetic wave with high efficiency in wide bandwidth.

DESCRIPTION OF EMBODIMENTS

Figure 1:
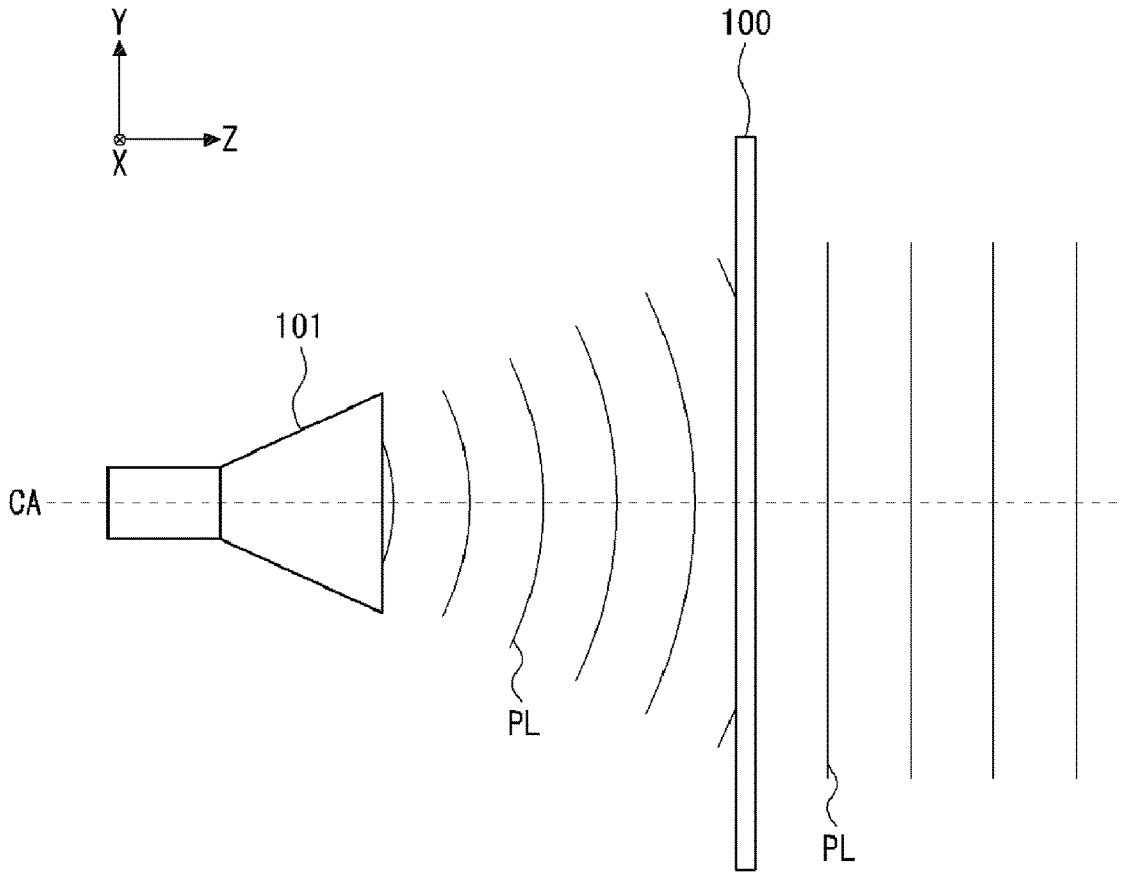
FIG. 1 illustrates a phase control device according to a first exemplary embodiment.

Exemplary embodiments of the present invention will be described below with reference to the drawings. In the drawings, the same elements are denoted by the same reference numerals, and thus a repeated description is omitted as needed.

First Exemplary Embodiment

Figure 2:
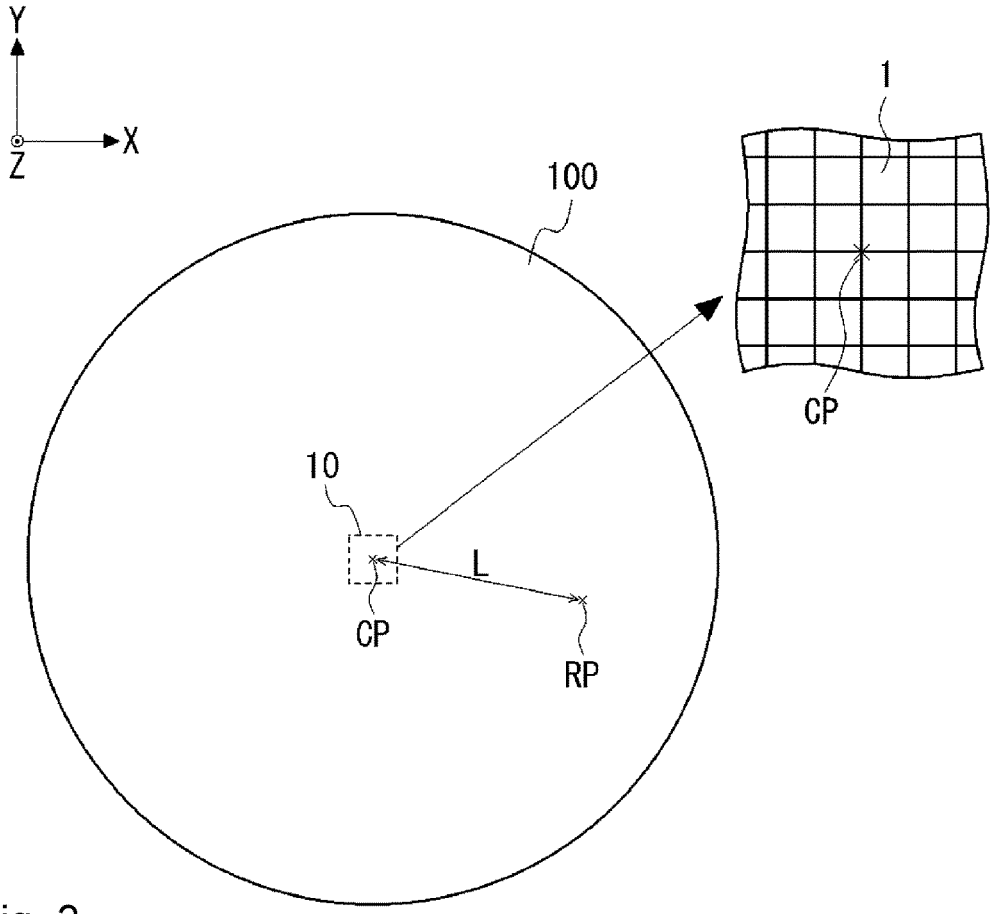
FIG. 2 illustrates a plan view of the phase control device according to the first exemplary embodiment.

A phase control device according to a first exemplary embodiment will be described. FIG. 1 illustrates a phase control device 100 according to the first exemplary embodiment. FIG. 2 illustrates a plan view of the phase control device 100 according to the first exemplary embodiment. The phase control device 100 has a disk-like shape. A principal surface of the phase control device 100 is an X-Y plane in FIGS. 1 and 2. In FIG. 1, a central axis of the phase control device 100 is represented by a line CA. In FIG. 2, a center point of the phase control device 100 in the X-Y plane positioned on the central axis CA is represented by CP.

The phase control device 100 is configured to control a phase of an electromagnetic wave emitted from an antenna 101 while the electromagnetic wave passes through the phase control device 100. As illustrated FIGS. 1 and 2, one surface of the phase control device 100 faces the antenna 101. The phase control device 100 and the antenna 101 constitute an antenna system. In this case, a transmission direction of the electromagnetic wave is a Z-axis direction.

When the antenna 101 is not a directional antenna, the antenna 101 isotropically emits the electromagnetic wave. Various types of antennas such as a horn antenna, a dipole antenna, and a patch antenna can be used as the antenna 101. Therefore, when the electromagnetic wave reaches the surface of the phase control device 100 facing the antenna 101, the phase of the electromagnetic wave is not uniform on this surface of the phase control device 100. In FIG. 1, a plane and a rounded surface on which the phase of the electromagnetic wave is equal are represented by a line PL. As illustrated in FIG. 1, on the surface of the phase control device 100 facing the antenna 101, the farther from the center point CP, the more the phase of the electromagnetic wave delays.

Thus, in the present exemplary embodiment, the phase control device 100 controls the phase of the electromagnetic wave to emit the electromagnetic wave having a phase plane perpendicular to the transmission direction. In other words, the phase plane is the X-Y plane perpendicular to the Z-axis direction.

Figure 3:
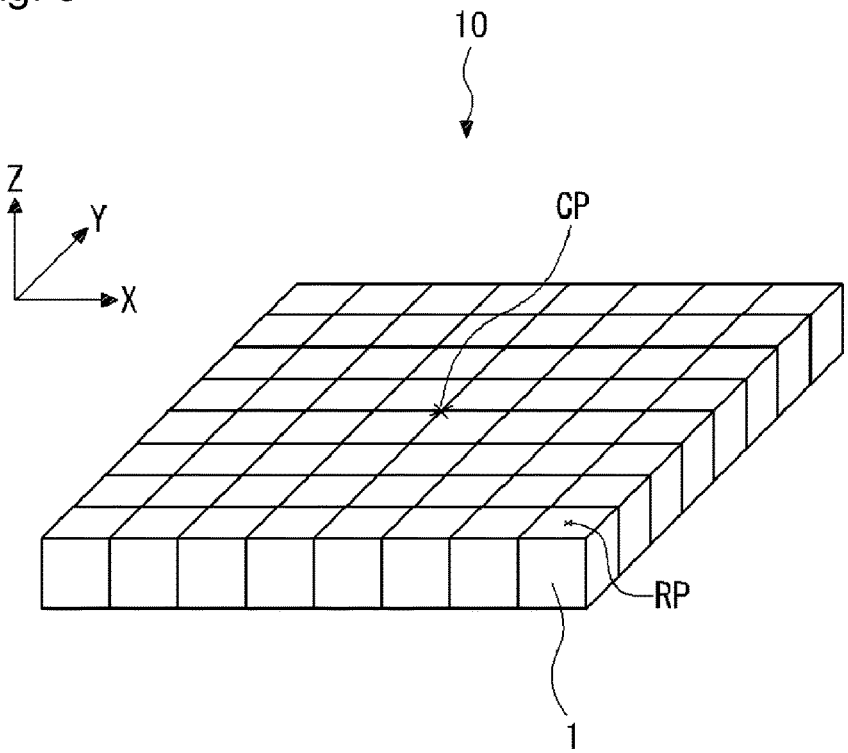
FIG. 3 illustrates a part of the phase control device.

FIG. 3 illustrates a part of the phase control device 100 indicated by a numerical sign 10 in FIG. 2. The phase control device 100 includes a plurality of three-dimensional units. In this case, the phase control device 100 includes a plurality of cube units 1. The cube units 1 are arranged in a matrix manner in the X-Y plane. In other words, the cube units 1 are arranged to constitute a two-dimensional array of cube units. In FIG. 3, the part 10 of the phase control device 100 is illustrated as an array of 8*8=64 cube units.

Note that a shape of the three-dimensional unit in not limited to the cube. As long as the three-dimensional units can be densely arranged without any space, other shapes such as a cuboid and a hexagonal column can be adopted as the shape of the three-dimensional unit.

As illustrated in FIG. 3, a reference point located at a center of each cube unit in the X-Y plane is indicated by RP. Note that, for simplification, the reference point RP of only one cube unit is illustrated in FIG. 3. In this case, as described above, as the distance L from the center point CP to the reference point RP (illustrated in FIG. 2) increases, the phase of the electromagnetic wave reaching the cube unit from the antenna 101 delays. Therefore, the phase control device 100 is configured in such a manner that a phase delay amount of the cube unit decreases as the distance L from the center point CP to the reference point RP increases in order to uniform the phase of the electromagnetic wave emitted from the surface of the phase control unit 100 not facing the antenna 100.

Accordingly, the phase control device 100 focuses the electromagnetic wave emitted from the antenna like a convex lens.

A size of the cube unit is smaller than a wavelength of the electromagnetic wave. Therefore, the array of the cube units 1 functions as electromagnetic continuous medium. Refractive index and impedance can be controlled independently by controlling equivalent permeability and equivalent permittivity according to configurations of the cube units.

Figure 4:
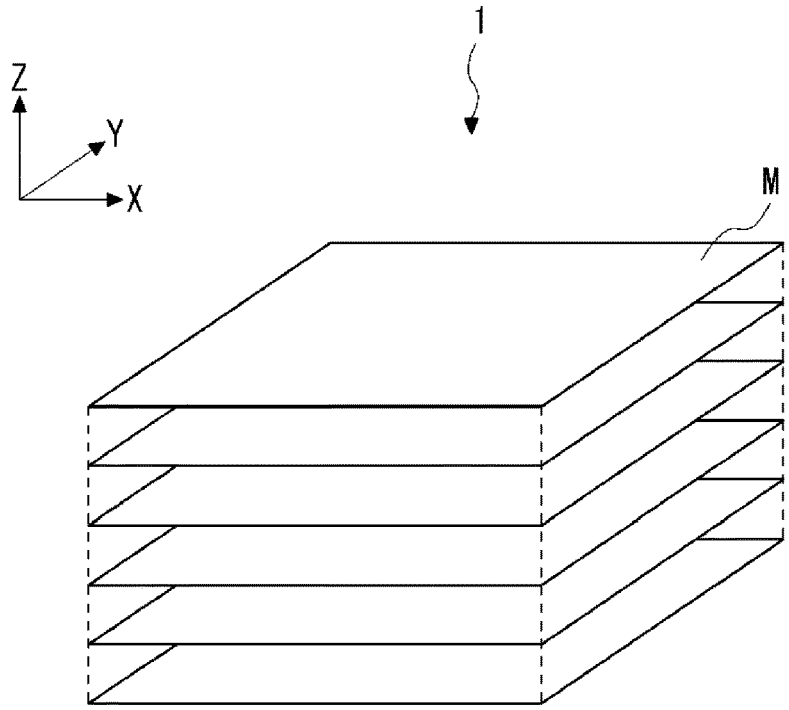
FIG. 4 illustrates an example of a cube unit including six metal layers.

A basic structure of the cube unit 1 will be described. Each cube unit 1 includes a plurality of metal layers stacked in the perpendicular direction (Z-axis direction) to the surface of the phase control device 100 (X-Y plane). FIG. 4 illustrates an example of the cube unit 1 with six metal layers M. In FIG. 4, the metal layer M has a square shape. The adjacent two metal layers M are insulated by a dielectric layer. For simplification, the dielectric layer is not illustrated in FIG. 4 and the following drawings as appropriate. In sum, the metal layers M and the dielectric layers are alternately stacked in the Z-axis direction. Thus, the cube unit 1 illustrated in FIG. 4 includes six metal layers M and five dielectric layers that are alternately stacked. Here, the metal layers and the dielectric layers have the same outer shape and the size in the X-Y plane.

The shape of the metal layer is not limited to the square shape. Another shape such as a rectangle and a round shape can be adopted. Further, the number of the metal layers and the number of the dielectric layers are not limited to those in the example of FIG. 4. Thus, the number of the metal layers may be any plural number and the number of the dielectric layers may be any number corresponding to the number of the metal layers.

The metal layer and the dielectric layer can be formed by various manufacturing method such as vacuum deposition including chemical vapor deposition, plating and spin coating, for example.

Figure 5:
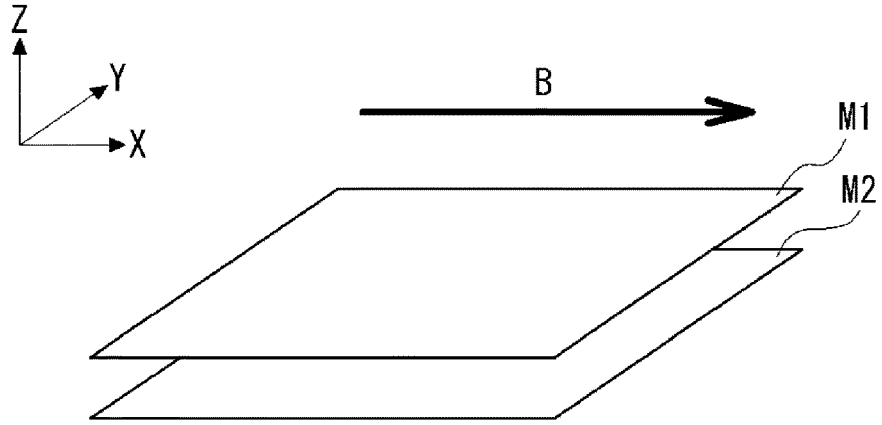
FIG. 5 illustrates an example of equivalent permeability control with a configuration including two metal layers and one dielectric layer.

Subsequently, control of equivalent permeability of the cube unit will be described. FIG. 5 illustrates an example of equivalent permeability control with a configuration including two metal layers and one dielectric layer. Two metal layers M1 and M2 are disposed in parallel in the Z-axis direction and the dielectric layer is interposed between the metal layers M1 and M2. When a magnetic field B having components parallel to the metal layers M1 and M2 is applied to the present configuration, a current J flows in the metal layers M1 and M2 in a direction opposite to a direction of the magnetic field B. The current J can be determined by adjusting admittance of the metal layer. The admittance of the metal layer is determined by the shape of the metal layer. Therefore, by appropriately designing the shape of the metal layer, the magnetic field induced by the current J can be controlled so that the equivalent permeability can be controlled.

Figure 6:
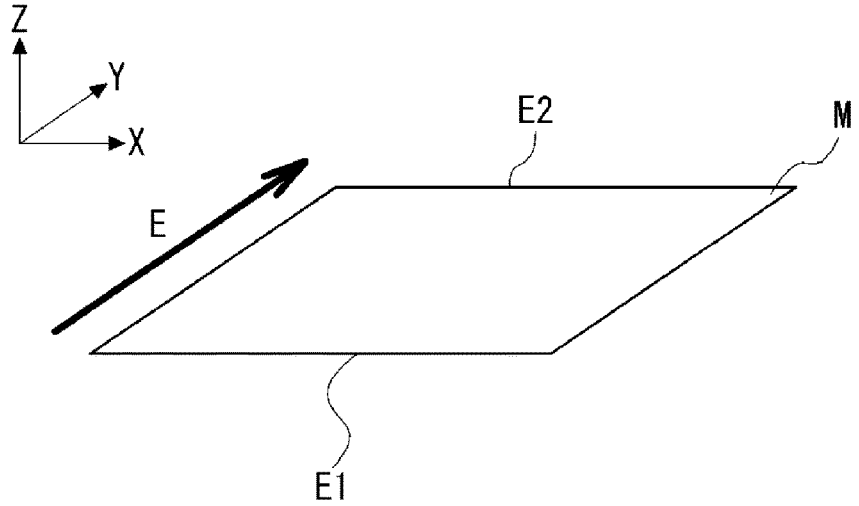
FIG. 6 illustrates an example of equivalent permittivity control with a configuration including a single metal layer.

Next, control of equivalent permittivity of the cube unit will be described. FIG. 6 illustrates an example of equivalent permittivity control with a configuration including a single metal layer. When an electric field E having components parallel to the metal layer M is applied, a potential difference is induced between two edges E1 and E2. The current J generated by this potential difference can be determined by adjusting the admittance of the metal layer. Therefore, by appropriately adjusting the shape of the metal layer, the electric field generated by the current J can be adjusted so that the equivalent permittivity can be controlled.

As described above, by appropriately designing the metal layers, the equivalent permeability and the equivalent permittivity can be controlled. In this case, impedance Z and a phase constant β are respectively expressed by the following formulas (1) and (2):

$$Z = \frac{\mu_{equiv}}{\varepsilon_{equiv}}, \tag{1}$$

$$\beta = \omega\sqrt{\mu_{equiv} \cdot \varepsilon_{equiv}}, \tag{2}$$

where $\mu_{equiv}$ indicates the equivalent permeability, $\varepsilon_{equiv}$ indicates the equivalent permittivity, and ω indicates an angular frequency of the electromagnetic wave.

Thus, it is possible to achieve arbitrary phase shift of the electromagnetic wave passing through the cube unit by controlling the equivalent permittivity and the equivalent permeability. Further, no power can be theoretically reflected by designing the cube unit to have the same impedance as an external environment, for example, air.

Figure 7:
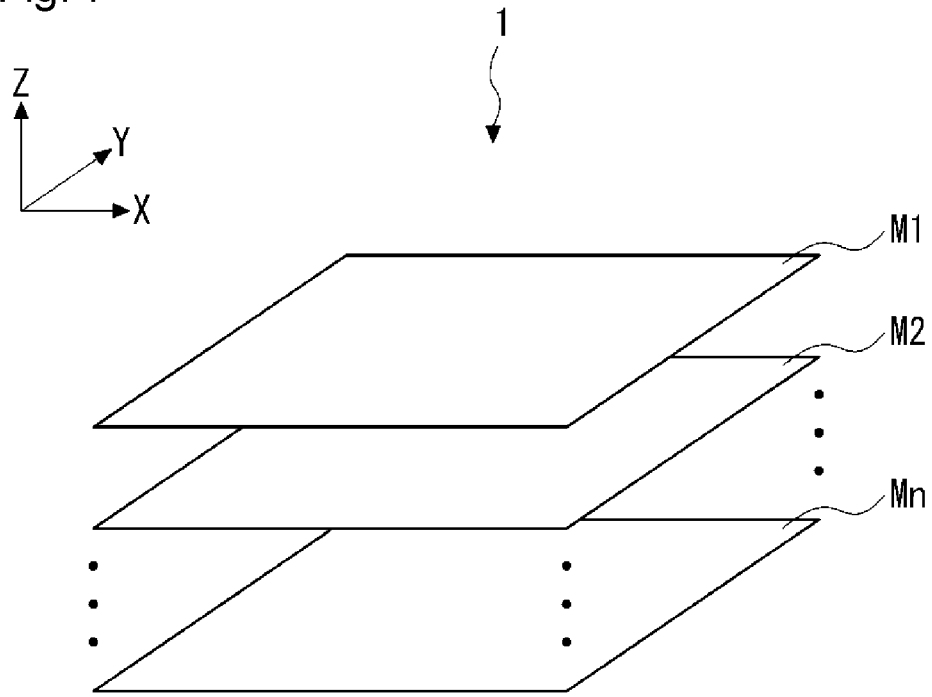
FIG. 7 illustrates an example of a cube unit including n metal layers and (n−1) dielectric layers that are alternately stacked.
Figure 8:
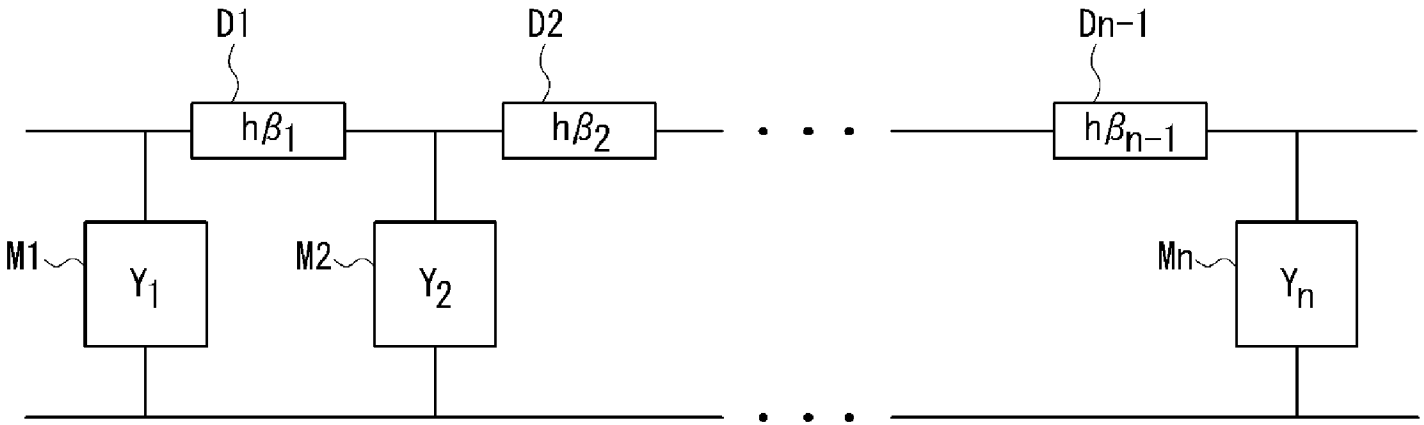
FIG. 8 illustrates an equivalent circuit of a configuration illustrated in FIG. 7.

FIG. 7 illustrates an example of a cube unit including n metal layers M1 to Mn and (n−1) dielectric layers that are alternately stacked, where n is an integer equal to or more than two. FIG. 8 illustrates an equivalent circuit of a configuration illustrated in FIG. 7. In FIG. 8, $Y_j$ is admittance of a j-th metal layer, $\beta_k$ is a phase constant of a k-th dielectric layer Dk, and h is a thickness of the dielectric layer, where j is an integer equal to or less than n and k is an integer equal to or less than n−1. ABCD-matrices of the metal layer and the dielectric layer can be calculated using the equivalent circuit illustrated in FIG. 8. Thus, the ABCD-matrix of the cube unit including n metal layers can be calculated and be transformed into S-parameters. Therefore, transmittance and a phase of transmission coefficient of the present configuration can be derived. Based on these formulas, it is possible to calculate desired admittance of each metal layer which is determined by metal patterns.

Figure 9:
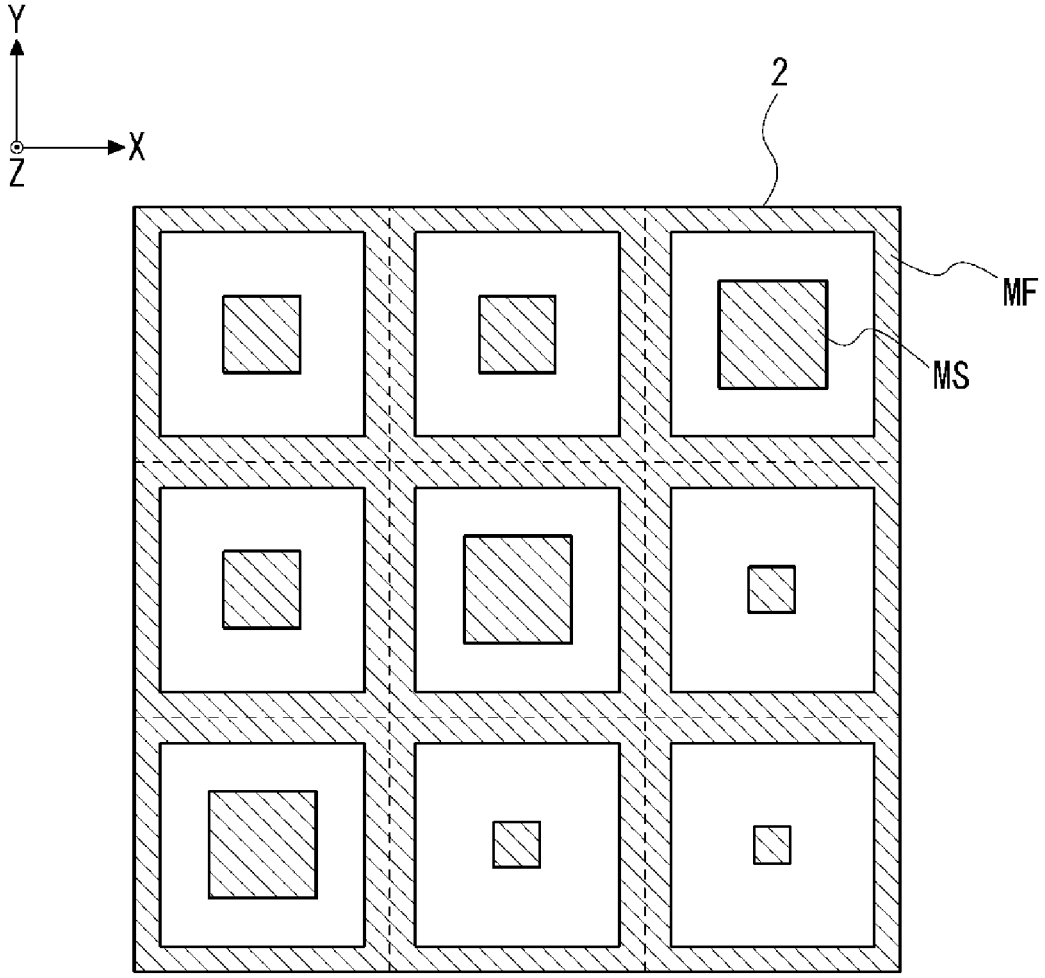
FIG. 9 illustrates an example of one metal layer included in a cube unit.

Next, other shapes of the metal layers will be described in detail. FIG. 9 illustrates an example of one metal layer included in the cube units. As illustrated in FIG. 9, the metal layer includes a metal frame MF and a metal square MS. The metal frame MF is configured as a metal closed-loop along a perimeter of the shape of the metal layer. The metal square MS is placed in an area surrounded by the metal frame MF to be insulated from the metal frame MF. Note that widths of the metal frames MF and sizes of the metal squares MS of the metal layers disposed in cube units 2 may be different from each other or the same. In this configuration, the combination of the metal frame MF and the metal square MS can be regarded as a combination of inductors L and capacitors C.

Here, it should be appreciated that, when metal patterns included in adjacent two cube units are formed on the same plane, the metal patterns may be continuously formed across the border.

Figure 10:
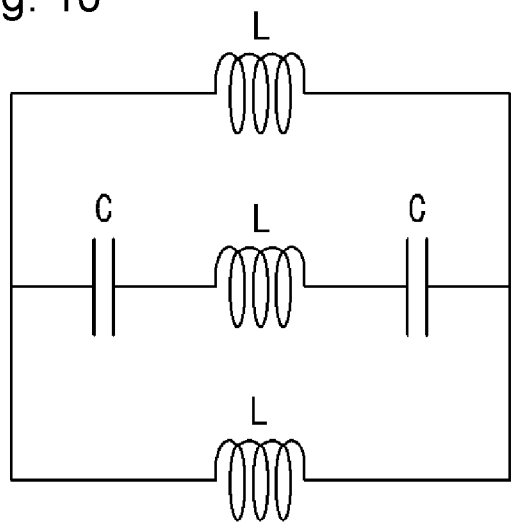
FIG. 10 illustrates an equivalent circuit of a combination of a metal frame and a metal square.

FIG. 10 illustrates an equivalent circuit of the combination of the metal frame and the metal square. When a magnetic field B occurs in an X-axis direction and an electric field E appears along a Y-axis direction, metal parts in a ring shape are equivalent to inductors and gaps between metal parts separated from each other can be equivalent to capacitors. Accordingly, by designing the metal frame MF and the metal square MS, inductance and capacitance can be adjusted.

Figure 11:
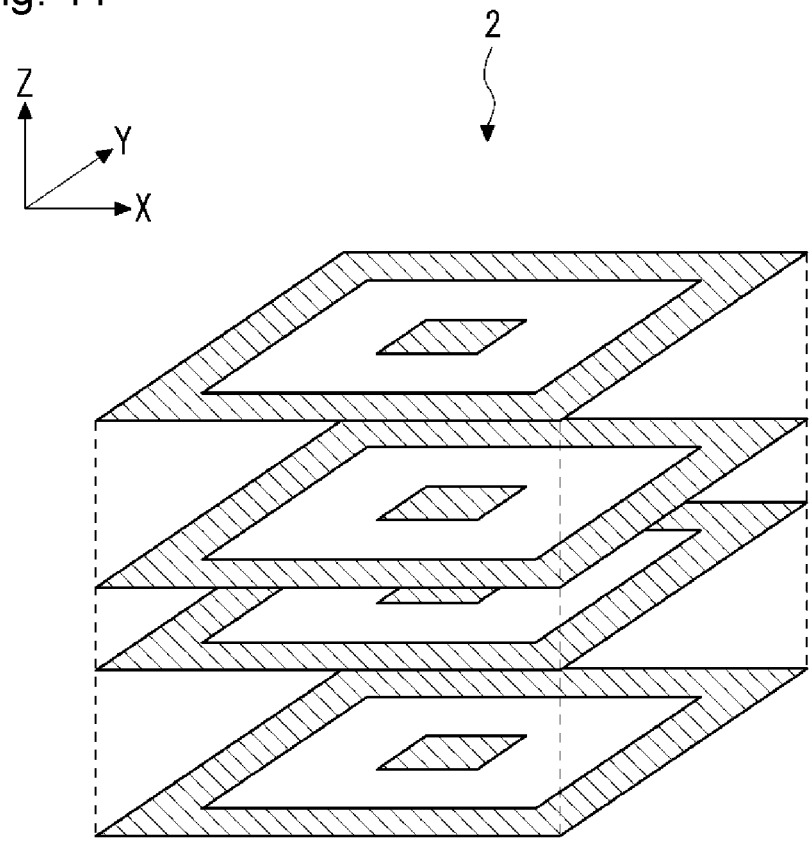
FIG. 11 illustrates a first example of a basic structure of a cube unit in which four metal layers are stacked.

An example of a basic structure of cube units will be described. FIG. 11 illustrates a first example of a basic structure of the cube unit 2 in which four metal layers are stacked. In this example, the metal layers have the same outer shape as the metal layer illustrated in FIG. 9.

Figure 12:
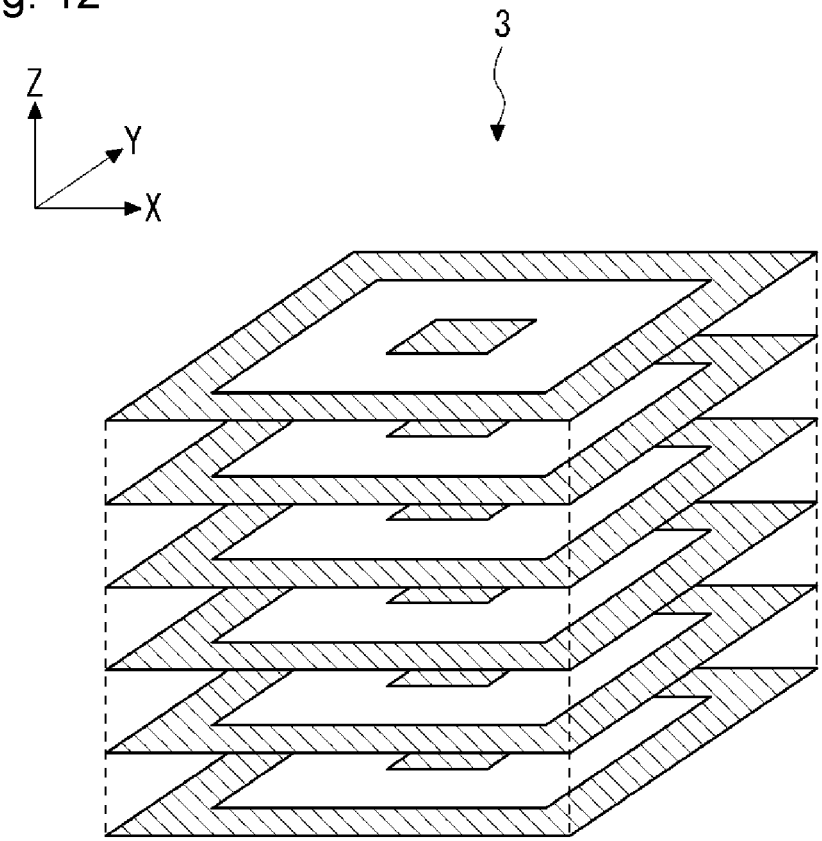
FIG. 12 illustrates a second example of a basic structure of a cube unit in which six metal layers are stacked.

Next, another example of the basic structure of the cube unit will be described. FIG. 12 illustrates a second example of the basic structure of a cube unit 3 in which six metal layers are stacked. In this example, the metal layers have the same shape as the metal layer illustrated in FIG. 9.

Figure 13:
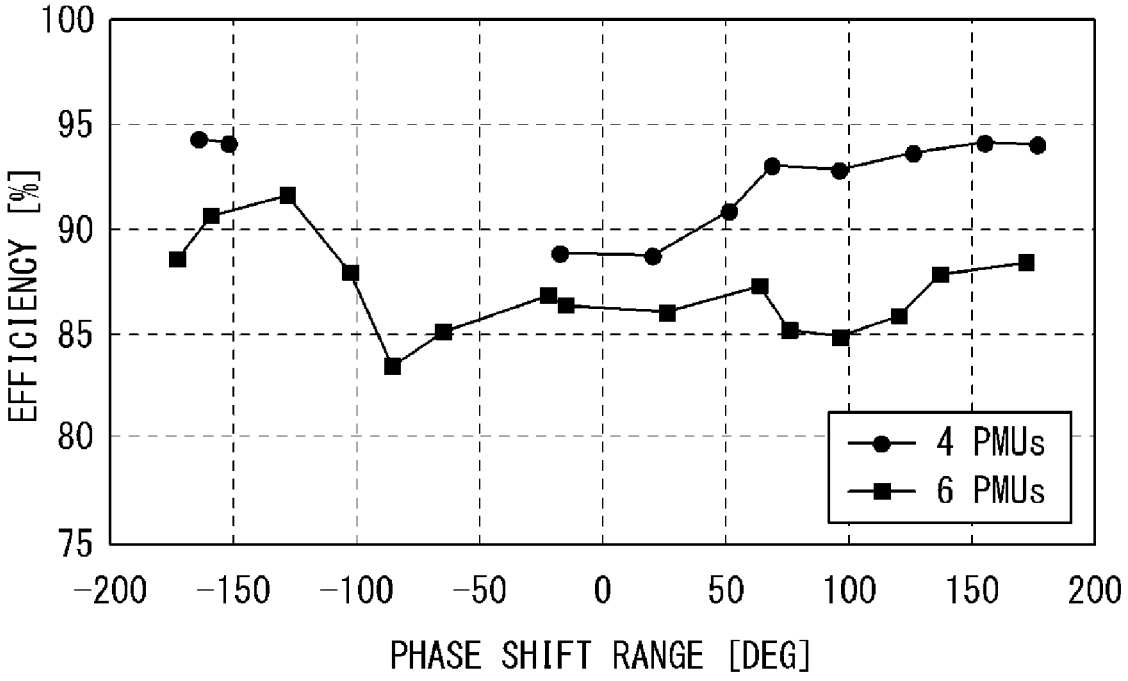
FIG. 13 illustrates simulation results of configurations illustrated in FIGS. 11 and 12.

Phase shift due to the cube units 2 and 3 illustrated in FIGS. 11 and 12 will be described. FIG. 13 illustrates simulation results of the cube units illustrated in FIGS. 11 and 12. In this simulation, a phase shift range is adjustable according to a size of the metal square MS. As illustrated in FIG. 13, it can be understood that it is possible to achieve the phase shift with high efficiency by appropriately design metal layers illustrated FIG. 11 (referred to as 4 PMUs in FIG. 13).

From FIG. 8, it can be easily understood that, since the cube unit including less metal layers has less freedom in required admittance value for each metal layer, there is a phase shift range that is difficult to be covered. Then, equivalent admittance is achieved through a strong resonance in the equivalent circuit. As a result, large loss caused by large current flow in the metal layers occurs or a bandwidth becomes narrower at a specific phase shift range.

Therefore, as illustrated in FIG. 13, the cube unit 2 including four metal layers cannot cover the all of the phase shift range from 0 to 360 degrees. In contrast to this, the cube unit 3 including six metal layers can cover the all of the phase shift range with lower efficiency than the cube unit 2.

Note that the cube unit can be considered as separated cube units including two or three metal layers. In this case, the dielectric layer interposed between the separated cube units is considered as an additional dielectric layer as appropriate. Thus, it can be understood the cube unit 3 can be formed by stacking the separated cube units including three metal layers and the additional dielectric layers. In the configuration illustrated in FIG. 12, one separated cube unit including three metal layers is only required to cover half of the phase shift range from 0 to 180 degrees, and the other separated cube unit including three metal layers is required to cover half of the phase shift range from 180 to 360 degrees. According to this configuration, the narrow phase shift range and narrow bandwidth of the cube unit 2 including four metal layers can be solved. Therefore, in order to cover the all of the phase shift range, the cube unit 3 is designed as illustrated in FIG. 12.

Since the cube unit 3 including six metal layers is equivalent to two cube units including three metal layers, a higher loss is inevitable as compared to the case of the cube unit 2 including four metal layers. Therefore, in the present exemplary embodiment, in order to achieve both of the high efficiency and a wide bandwidth, the cube units including different numbers of the metal layers are combined to configure the phase shift device 100.

Figure 14:
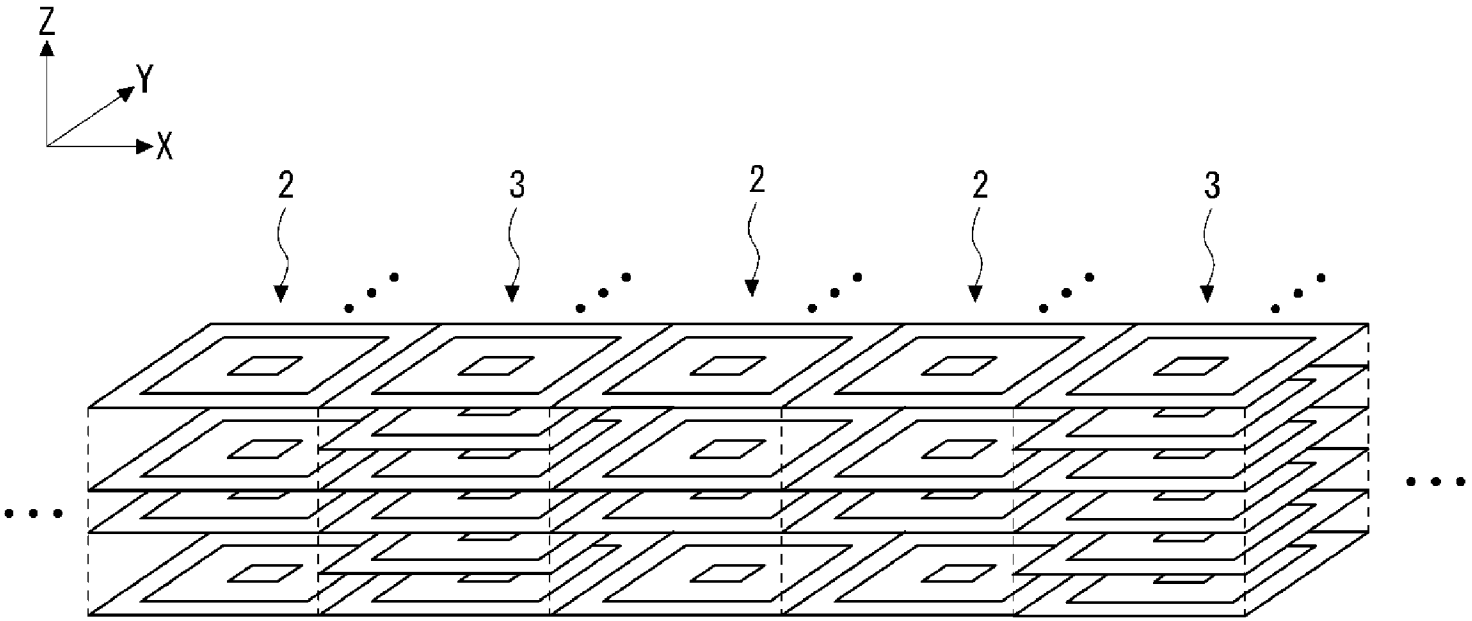
FIG. 14 illustrates a combination of the cube units including different numbers of the metal layers.

FIG. 14 illustrates a combination of the cube units including different numbers of the metal layers in the phase control device 100. As illustrated in FIG. 14, the cube unit 2 including four metal layers capable achieving high efficiency and covering only half of the all of the phase shift range and the cube unit 3 including six metal layers capable of achieving low efficiency and covering the all phase shift range are combined. Thus, in this configuration, the cube unit 2 can correspond to a main phase shift range (a right side range in FIG. 13) to satisfy a phase shift requirement and the cube unit 3 can correspond to the all of the phase shift range including the main phase shift range and the other phase shift range (a left side range in FIG. 13).

As described above, according to the present configuration, it is possible to realize the phase control device capable of achieving arbitrary phase shift with high efficiency by combining the three-dimensional units having different coverages of the phase shift range, especially, by combining the cube units including different numbers of the metal layers, in other words, by combining the cube units having different basic structures.

Note that the phase control described with reference to FIG. 1 is merely an example. The phase control device may be configured in such a manner that a phase delay amount of the cube unit increases as the distance L from the center point CP to the reference point RP increases. In this case, the phase control device may be configured to diffuse the electromagnetic wave like a concave lens according to usage of the electromagnetic wave by appropriately designing the cube units serving as the three-dimensional units.

Further, the transmission direction of the electromagnetic wave emitted from the antenna and reaching the phase control device is not limited to the direction (Z-axis direction) perpendicular to the surface (X-Y plane) of the phase control device. The transmission direction of the electromagnetic wave emitted from the antenna and reaching the phase control device may be tilted with respect to the direction (Z-axis direction) perpendicular to the surface (X-Y plane) of the phase control device. Additionally, the transmission direction of the electromagnetic wave emitted from the phase control device is not limited to the direction (Z-axis direction) perpendicular to the surface (X-Y plane) of the phase control device. The transmission direction of the electromagnetic wave emitted from the phase control device may be tilted with respect to the direction (Z-axis direction) perpendicular to the surface (X-Y plane) of the phase control device by appropriately designing the cube units serving as the three-dimensional units.

Second Exemplary Embodiment

In a second exemplary embodiment, examples of basic structures of three-dimensional units will be described. In examples of the present exemplary embodiment, metal layers of nine cube units are illustrated in the drawings and a border between the cube units is indicated by a dashed line.

Figure 15:
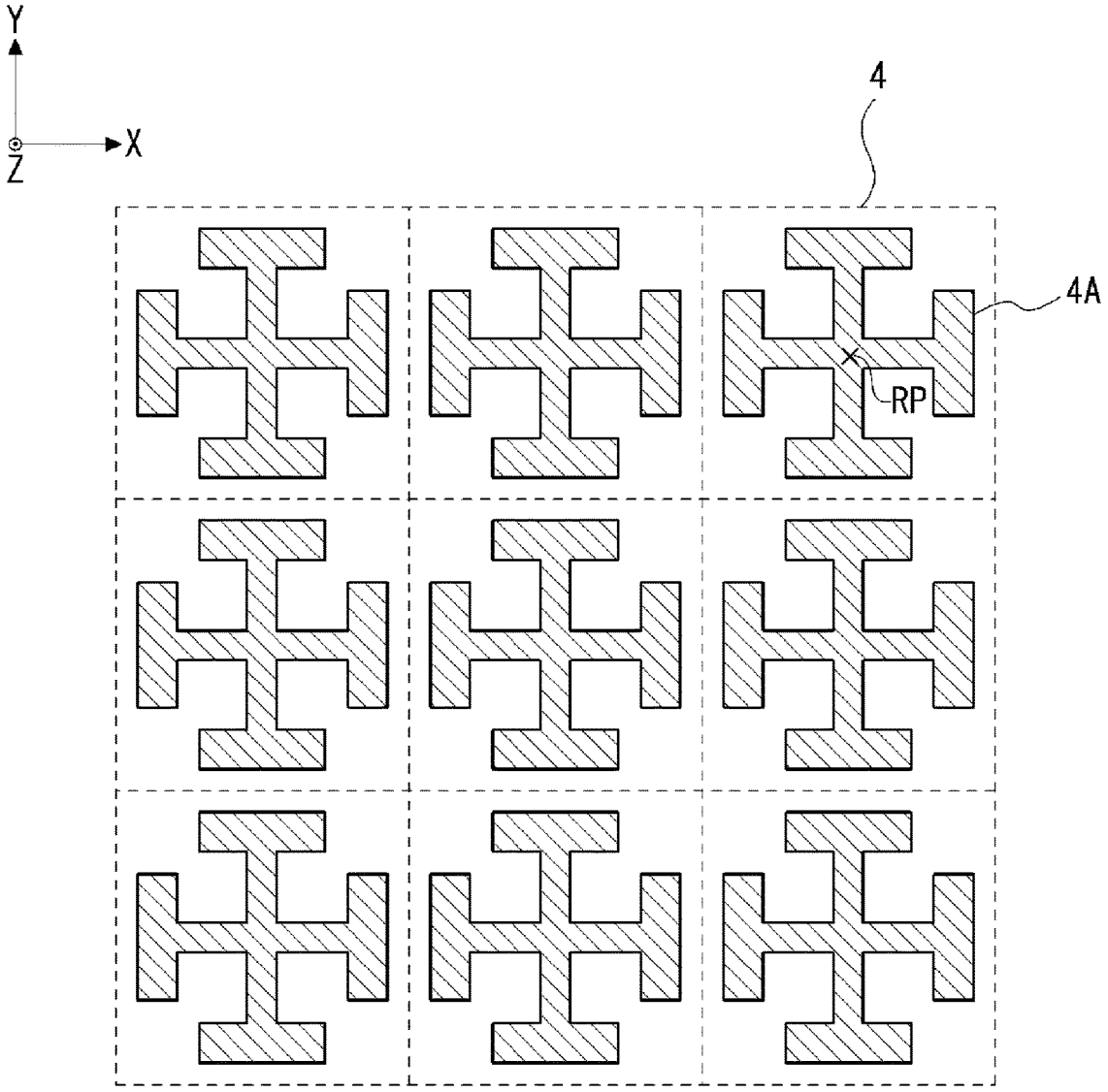
FIG. 15 illustrates a third example of a basic structure of a cube unit.

FIG. 15 illustrates a third example of a basic structure of a cube unit. In this example, a cross-shape metal 4A in which one metal line extending along the X-axis direction and the other metal line extending along Y-axis direction intersect with each other at the reference point RP is disposed in a cube unit 4. Further, four metal tips are respectively disposed ends of the crossed metal lines so as to extend directions orthogonal to the lines.

Figure 16:
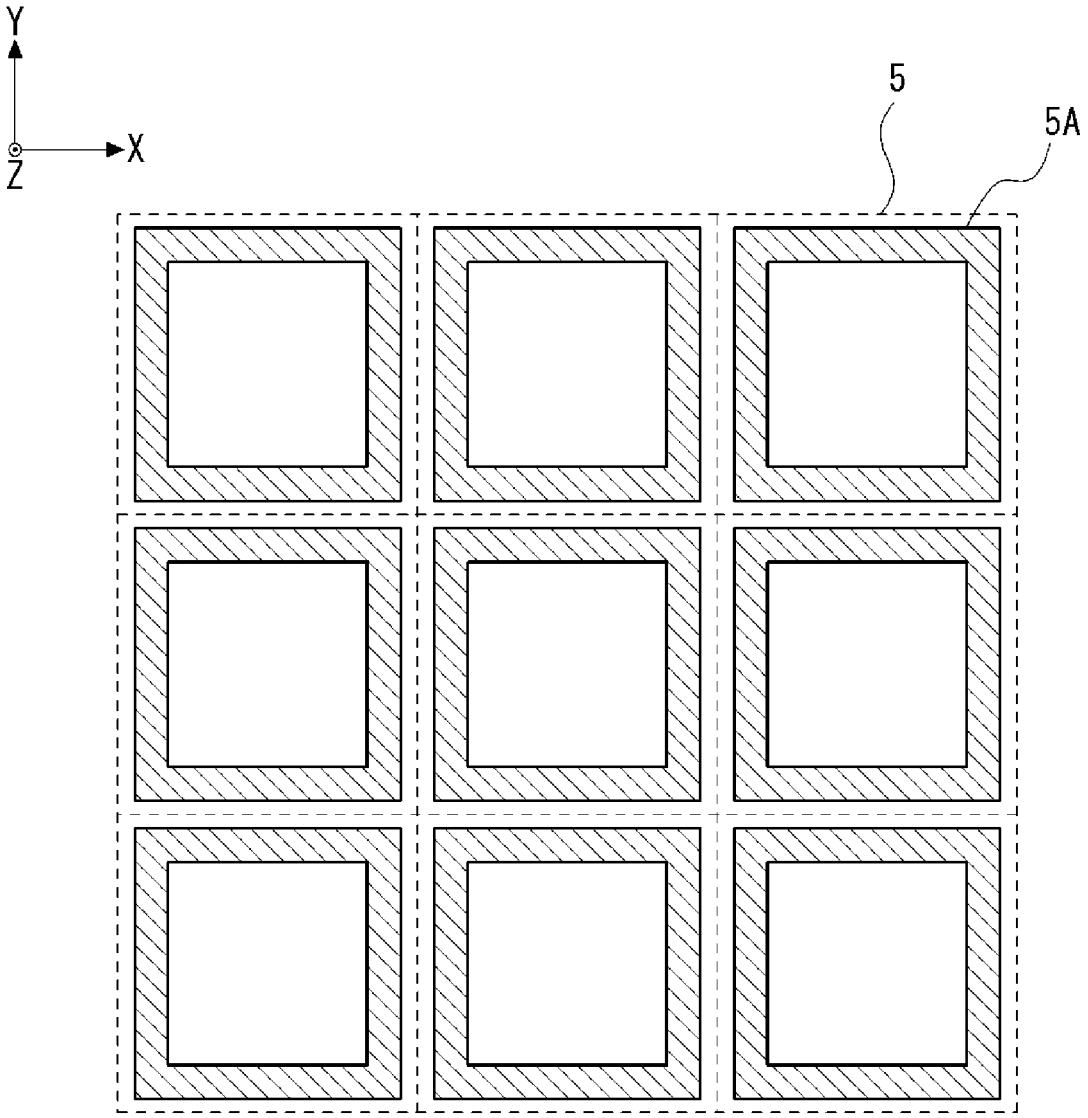
FIG. 16 illustrates a fourth example of a basic structure of a cube unit.

FIG. 16 illustrates a fourth example of a basic structure of a cube unit. In this example, a square ring-shape metal 5A is disposed in a metal layer in a cube unit 5.

Figure 17:
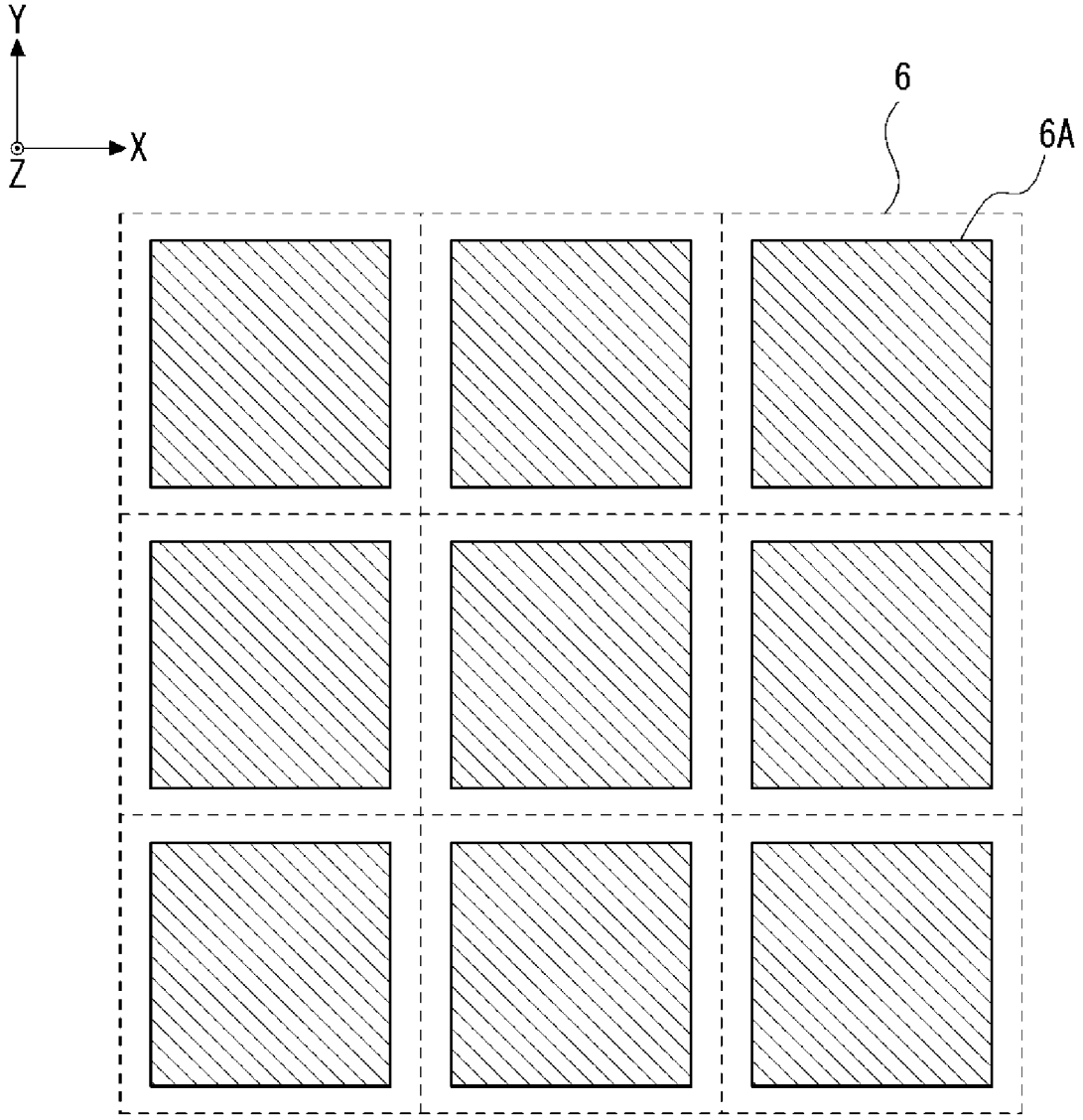
FIG. 17 illustrates a fifth example of a basic structure of a cube unit.

FIG. 17 illustrates a fifth example of a basic structure of a cube unit. In this example, an island-shape metal 6A is disposed in a metal layer in a cube unit 6.

In the third to fifth examples, the X-axis is the direction of the electric field E, for example. It should be appreciated that the metal layers of the third to fifth examples can be configured to operate in the same manner, even when the direction of the electric field E is in any direction within the X-Y plane.

Figure 18:
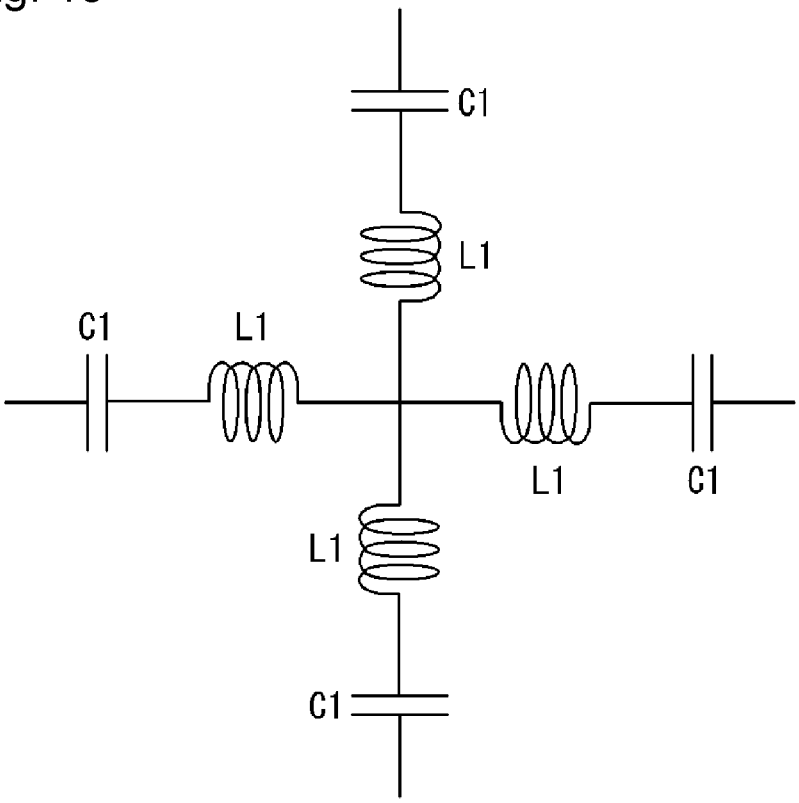
FIG. 18 illustrates a two-dimensional equivalent circuit of the metal layers illustrated in FIGS. 15 to 17.

FIG. 18 illustrates a two-dimensional equivalent circuit of the metal layers illustrated in FIGS. 15 to 17. As illustrated in FIG. 18, the two-dimensional equivalent circuit can be represented by four pairs of an inductor L1 and a capacitor C1. In one pair, one end of the inductor L1 is connected to one end of the capacitor C1. The other ends of the inductors L1 of the four pairs are connected to each other.

Further, other examples of basic structures of the three-dimensional units will be described. The metal layers described below are configured to constitute parallel resonance circuits.

Figure 19:
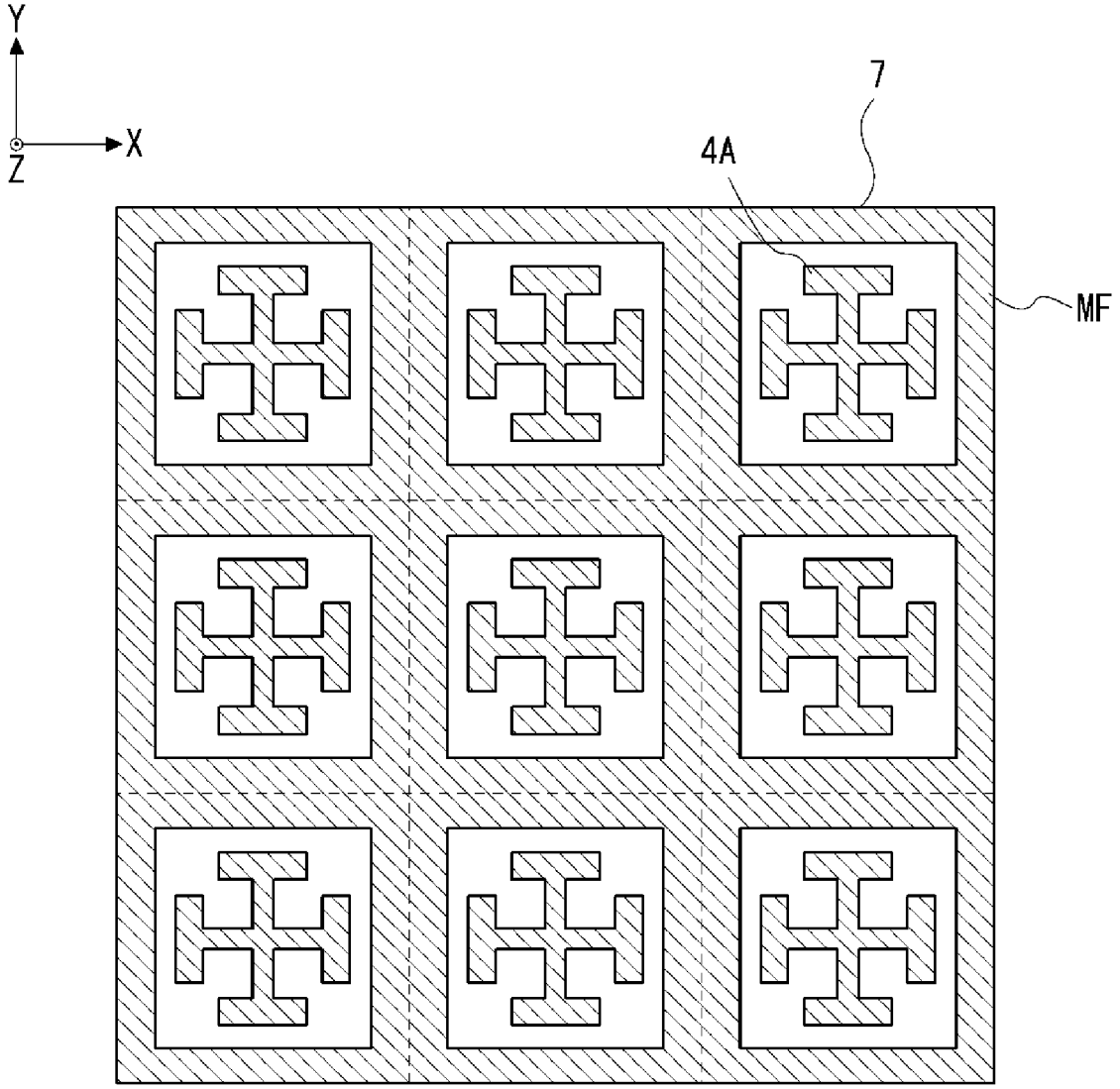
FIG. 19 illustrates a sixth example of a basic structure of a cube unit.

FIG. 19 illustrates a sixth example of a basic structure of a cube unit. In this example, in a cube unit 7, a cross-shape metal 4A illustrated in FIG. 15 is surrounded by a metal frame MF that is a square ring-shaped metal.

Figure 20:
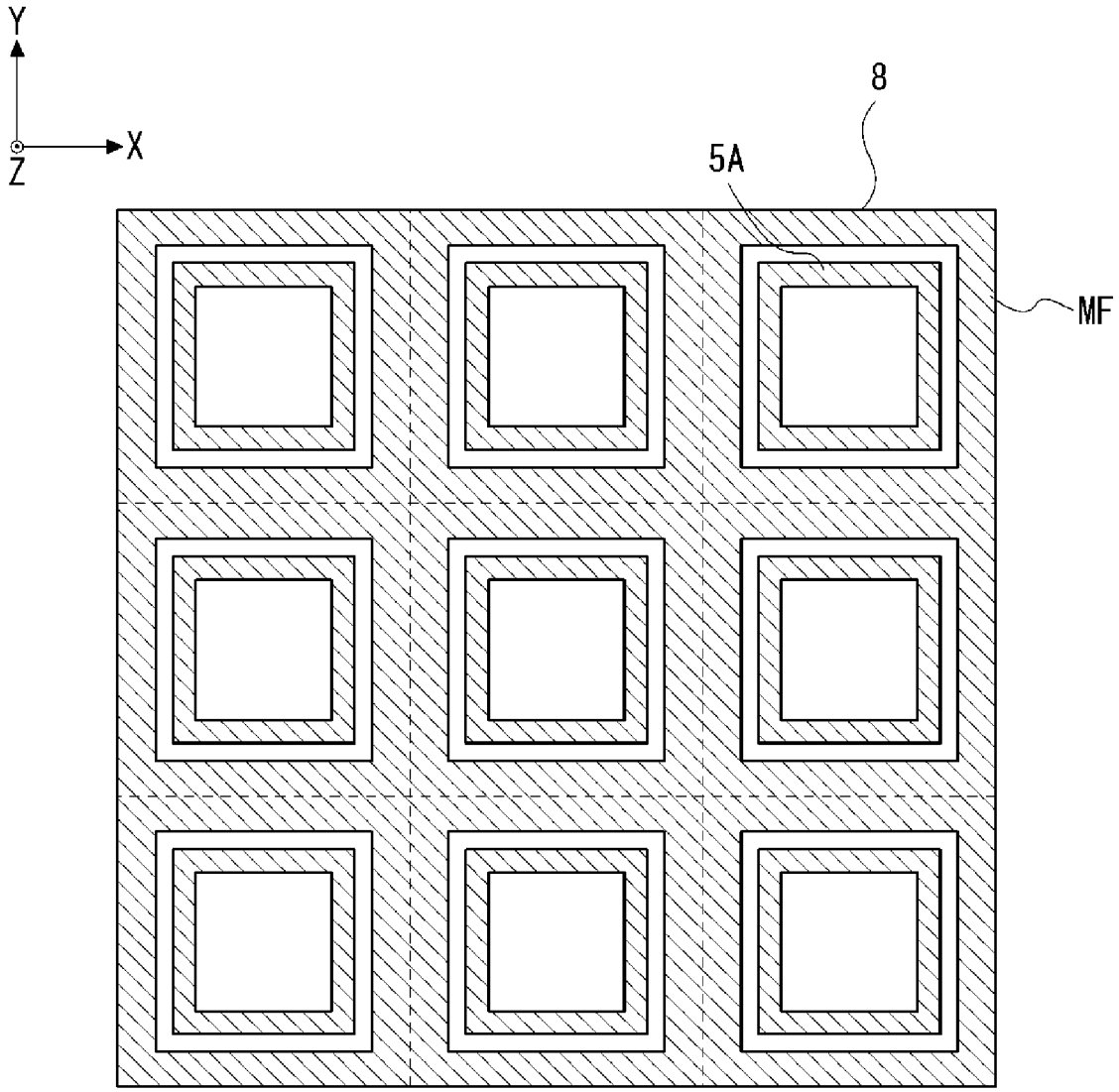
FIG. 20 illustrates a seventh example of a basic structure of a cube unit.

FIG. 20 illustrates a seventh example of a basic structure of a cube unit. In this example, in a cube unit 8, a square ring-shape metal 5A illustrated in FIG. 16 is surrounded by a metal frame MF that is a square ring-shaped metal.

Figure 21:
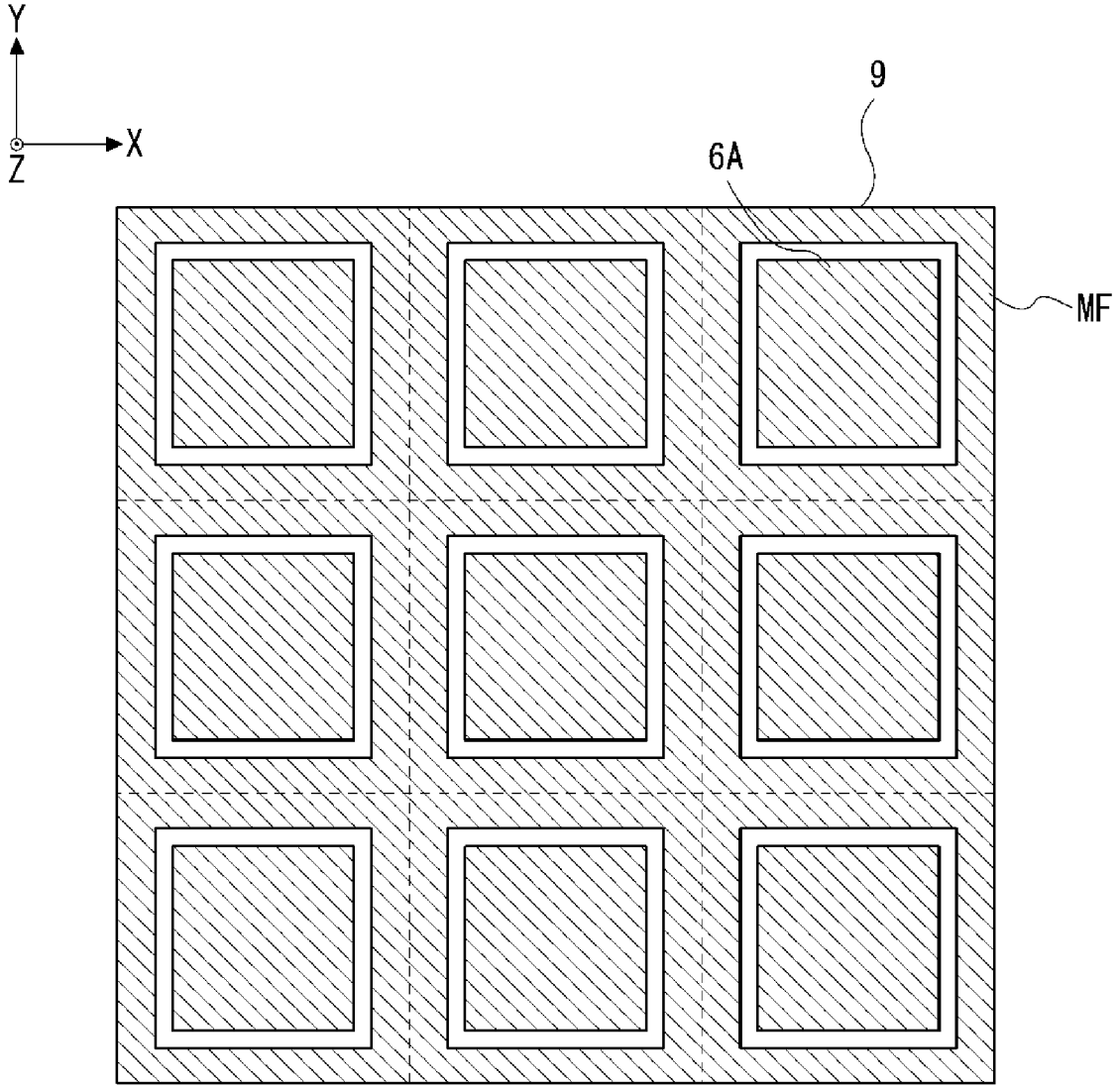
FIG. 21 illustrates an eighth example of a basic structure of a cube unit.

FIG. 21 illustrates an eighth example of a basic structure of a cube unit. In this example, in a cube unit 9, the island-shape metal 6A illustrated in FIG. 17 is surrounded by a metal frame MF that is a square ring-shaped metal.

In the sixth to eighth examples, the metal frames MF of the metal layers are connected and integrated as one metal part. The X-axis is the direction of the electric field E, for example. It should be appreciated that the metal layers illustrated in FIGS. 19 to 21 can be configured to operate in the same manner, even when the direction of the electric field E is in any direction within the X-Y plane.

Figure 22:
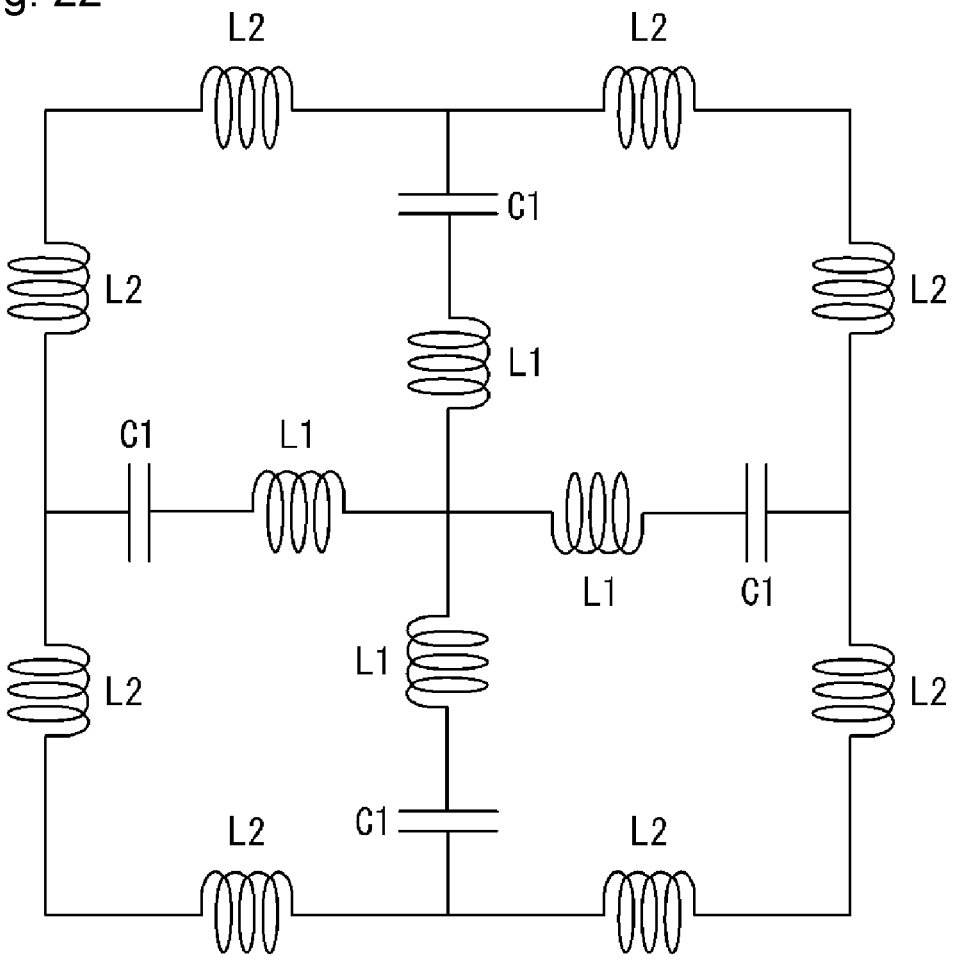
FIG. 22 illustrates a two-dimensional equivalent circuit of the metal layers illustrated in FIGS. 19 to 21.

FIG. 22 illustrates a two-dimensional equivalent circuit of the metal layers illustrated in FIGS. 19 to 21. The metal layers illustrated in FIGS. 19 to 21 function as parallel resonance circuits.

The equivalent circuit has a configuration in which the inductors L2 are added to the equivalent circuit illustrated in FIG. 18. The inductors L2 are formed by the metal frame MF. In this circuit, two inductors L2 are inserted between the other ends of two capacitors C1. Thus, the equivalent circuit is represented as a circuit in which eight inductors L2 are added to the equivalent circuit illustrated in FIG. 18.

As described above, the above metal layers of the third to eighth examples can be represented by the equivalent circuits with the inductors and capacitors. Therefore, it is possible to adjust equivalent permittivity and equivalent permeability of the three-dimensional unit as in the first exemplary embodiment.

As a result, according to the present configuration, it is possible to realize the phase control device capable of achieving arbitrary phase shift with high efficiency by combining the three-dimensional units having different coverages of the phase shift range.

Third Exemplary Embodiment

In a third exemplary embodiment, other arrangements of the three-dimensional units will be described.

Figure 23:
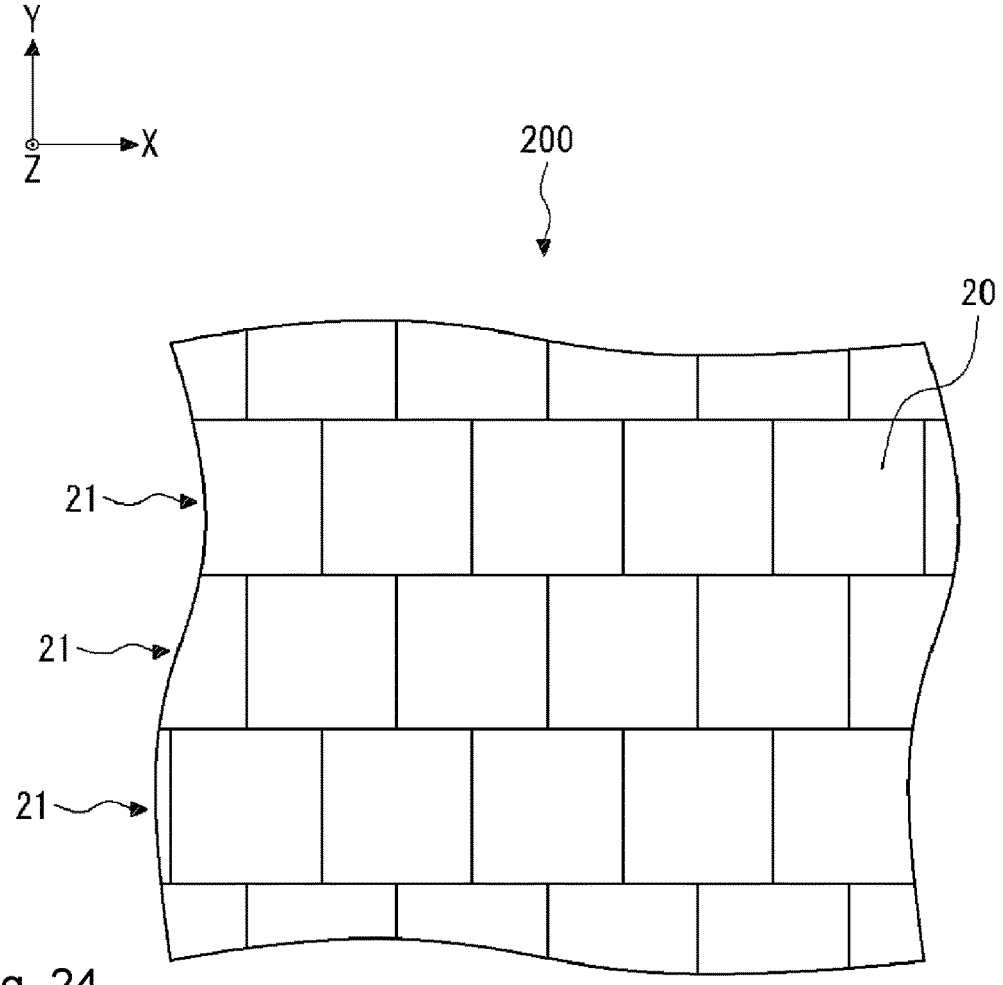
FIG. 23 illustrates another arrangement of the cube units.

FIG. 23 illustrates another arrangement of the cube units. In FIG. 23, a phase control device 200 includes a plurality of rows 21 densely arranged in the Y-axis direction without any spaces. The row 21 includes a plurality of cube units 20 densely arranged in the X-axis direction without any spaces. The adjacent two rows 21 are shifted in the X-axis direction by half of a width of the cube unit 20. Since the cube units 20 serving as the three-dimensional units are densely arranged without any spaces, the phase control device 200 can control the phase of the electromagnetic wave in the same manner as the phase control device 100 according to the first embodiment.

It should be appreciated that a plurality of cube units may be densely arranged in the Y-axis direction without any spaces to constitute a row and the rows may be densely arranged in the X-axis direction.

Figure 24:
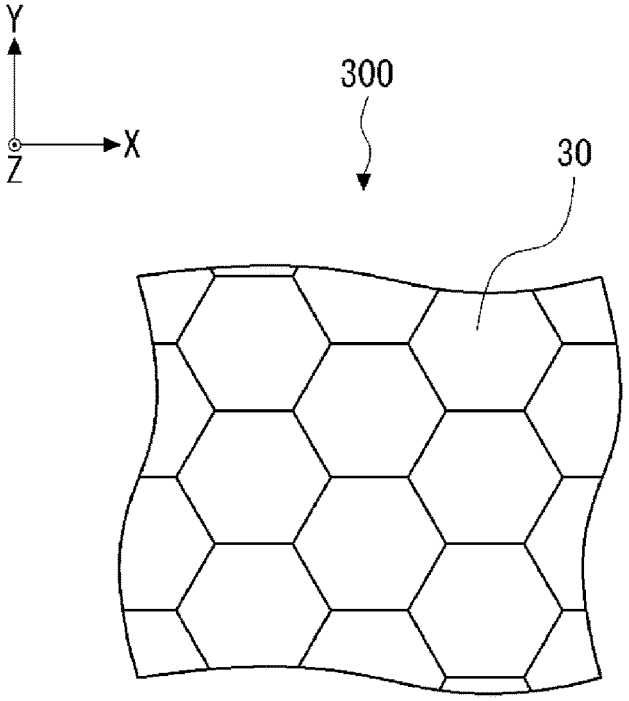
FIG. 24 illustrates a configuration of a phase control device including hexagonal columns.

Another configuration will be described. FIG. 24 illustrates a configuration of a phase control device 300 including hexagonal columns 30. In this configuration, the hexagonal column 30 is a basic structure of the three-dimensional unit. The hexagonal column 30 includes a plurality of the metal layers and the dielectric layers interposed therebetween. As illustrated in In FIG. 24, the hexagonal columns 30 are densely arranged without any spaces to constitute a so-called honeycomb structure. Since the hexagonal column 30 are densely arranged without any spaces, the phase control device 300 can control the phase of the electromagnetic wave in the same manner as the phase control device 100 according to the first embodiment.

Figure 25:
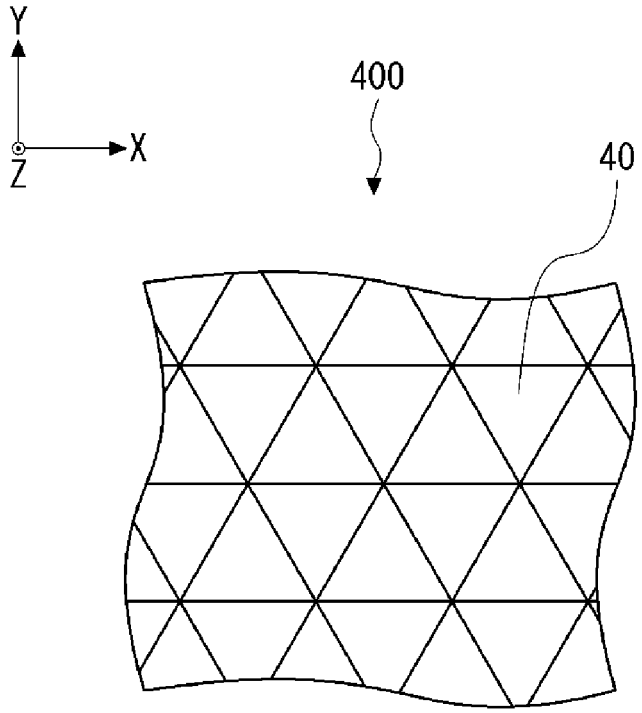
FIG. 25 illustrates a configuration of a phase control device including triangular columns.

Further configuration will be described. FIG. 25 illustrates a configuration of a phase control device 400 including triangular columns 40. In this configuration, the triangular unit 40 is a basic structure of the three-dimensional unit. The triangular column 40 includes a plurality of the metal layers and the dielectric layers interposed therebetween. As illustrated in In FIG. 25, a plurality of the triangular columns 40 are densely arranged without any spaces. Since the triangular columns 40 are densely arranged without any spaces, the phase control device 400 can control the phase of the electromagnetic wave in the same manner as the phase control device 100 according to the first embodiment.

As described above, the above three-dimensional units according to the present exemplary embodiment can be densely arranged without any spaces. Therefore, it is possible to adjust equivalent permittivity and equivalent permeability of the three-dimensional unit as in the first exemplary embodiment.

As a result, according to the present configuration, it is possible to realize the phase control device capable of achieving arbitrary phase shift with high efficiency by combining the three-dimensional units having different coverages of the phase shift range.

Other Embodiment

Note that the present invention is not limited to the above exemplary embodiments and can be modified as appropriate without departing from the scope of the invention. For example, the shapes of the three-dimensional units arranged in the phase control device are not limited to one shape. Thus, as long as the three-dimensional units can be densely arranged without any spaces and desired phase control can be achieved, various shapes such as the hexagonal column and the triangular column described above, a cube, and a cuboid can be combined to constitute the array of the three-dimensional units.

The metal layer may be formed by any metal and the dielectric layer may be formed by any dielectric material.

In the exemplary embodiment described above, two basic structures have been combined. However, it is merely an example. Therefore three or more structures can be combined to constitute the three-dimensional unit.

In the exemplary embodiment described above, the phase control device has configured as a disk-like shape device. However, the shape of the phase control device is not limited to this. For example, the phase control device may be configured as a board-like shape device other than the disk-like shape device.

While the present invention has been described above with reference to exemplary embodiments, the present invention is not limited to the above exemplary embodiments. The configuration and details of the present invention can be modified in various ways which can be understood by those skilled in the art within the scope of the invention.

REFERENCE SIGNS LIST

C, C1 CAPACITORS
CA CENTRAL AXIS
CP CENTER POINT
RP REFERENCE POINT
D1 TO DN−1 DIELECTRIC LAYERS
L, L1, L2 INDUCTORS
M, M1 TO MN METAL LAYERS
MF METAL FRAME
MS SQUARE METAL
1 TO 9, 20 CUBE UNITS
4A CROSS-SHAPE METAL
5A RING-SHAPE METAL
6A ISLAND-SHAPE METAL
21 ROW
30 HEXAGONAL COLUMN
40 TRIANGULAR COLUMN
100, 200, 300, 400 PHASE CONTROL DEVICES
101 ANTENNA

What is claimed is:

1. A phase control device comprising a two-dimensional array of three-dimensional units, wherein the two-dimensional array is configured to shift a phase of an electromagnetic wave passing through the three-dimensional units, each three-dimensional unit includes one of basic structures, each basic structure comprises stacked metal layers separated from each other, and the number of the metal layers of the basic structures are different from each other.

2. The phase control device according to claim 1, wherein each three-dimensional unit further comprises at least one dielectric layer alternately stacked with the metal layers in a direction perpendicular to a principal surface of the two-dimensional array, and the metal layer and the dielectric layer are configured to have the same outer shape and the same size so as to be capable of being densely arranged in the principal surface of the two-dimensional array without any spaces.

3. The phase control device according to claim 1, wherein the basic structures are configured to cover different phase shift ranges, or to cover phase shift ranges partly overlapped with each other.

4. The phase control device according to claim 3, wherein one basic structure is configured to cover a part of the all of the phase shift range and the other basic structure is configured to cover the all of the phase shift range.

5. The phase control device according to claim 1, wherein a delay amount of the phase of the electromagnetic wave passing through the three-dimensional unit increases or decreases as a distance between a center of the two-dimensional array and the three-dimensional unit increases.

6. The phase control device according to claim 1, wherein a transmission direction of the electromagnetic wave emitted from the two-dimensional array after the phase of the electromagnetic wave is shifted is the same direction as the direction perpendicular to the principal surface of the two-dimensional array or a direction tilted with respect to the direction perpendicular to the principal surface of the two-dimensional array.

7. An antenna system comprising:

an antenna configured to emit an electromagnetic wave; and a phase control device comprising a two-dimensional array of three-dimensional units, wherein the two-dimensional array is configured to shift a phase of an electromagnetic wave passing through the three-dimensional units, each three-dimensional unit includes one of basic structures, each basic structure comprises stacked metal layers separated from each other, and the number of the metal layers of the basic structures are different from each other.

8. A method of controlling a phase of an electromagnetic wave comprising emitting an electromagnetic wave to a phase control device, wherein the phase control device comprises a two-dimensional array of three-dimensional units, the two-dimensional array is configured to shift a phase of an electromagnetic wave passing through the three-dimensional units, each three-dimensional unit includes one of basic structures, each basic structure comprises stacked metal layers separated from each other, and the number of the metal layers of the basic structures are different from each other.

* * * * *